US005389033A

United States Patent [19]

Rauch

[11] Patent Number: 5,389,033

[45] Date of Patent: Feb. 14, 1995

[54] TOY SWORD MADE OF FOAM MATERIAL

[76] Inventor: Blair D. Rauch, 17449 64th Ct., Tinley Park, Ill. 60477

[21] Appl. No.: 95,407

[22] Filed: Jul. 23, 1993

[51] Int. Cl.[6] ..... A63H 33/00

[52] U.S. Cl. ..... 446/473; 482/12

[58] Field of Search ..... 446/473, 124, 125, 405; 273/84 R, 67 R, DIG. 4; 434/11; 482/12

[56] References Cited

U.S. PATENT DOCUMENTS

| | | | |
|---|---|---|---|
| 2,803,087 | 8/1957 | Zalkind | 446/473 |
| 3,790,175 | 2/1974 | Ragnow | 446/124 X |
| 4,740,188 | 4/1988 | Coster | 446/125 X |
| 5,127,871 | 7/1992 | Miller | 446/473 |

*Primary Examiner*—Mickey Yu
*Attorney, Agent, or Firm*—Gerald S. Geren

[57] ABSTRACT

A toy sword assembly or similar device is fabricated of a lightweight and flexible foam material. The assembly includes an elongated blade and handle subpart and a guard part that fits on a guard grasping section of the blade and handle subpart. The blade and handle subpart include interlocking and interfitting formations so that said subparts can be connected together and form an enlarged, three-dimensional, authentic-appearing cross-shaped cross-sectional sword. A planar one-piece guard is provided for cooperation with the assembled subparts. The guard has an internal aperture which is shaped to correspond to the cross-shaped configuration be fitted or mounted from the blade end, fit in the grasping section, be oriented at right angles to the blade and handle subparts and be mounted to the assembled subparts only from the blade end. Several embodiments of swords and similar devices are shown which employ the interlocking formations.

14 Claims, 3 Drawing Sheets

TOY SWORD MADE OF FOAM MATERIAL

BACKGROUND OF THE INVENTION

This invention relates to toy swords made of a foam material, usually for use by children, which includes an interlocking system whereby components are fabricated from a sheet of foam and then assembled to form a three dimensional sword or the like having a cross-shaped cross-section.

In existing toy swords, such as disclosed in U.S. Pat. No. 5,127,871, there is provided a flexible flat one-piece member which includes a bendable blade portion and a handle. A flexible guard piece is mounted on the handle portion by fitting over a knob at the handle bottom. The guard fits against a blade base (at the bottom of the blade) that is wider than the handle.

It has been determined that a larger more three-dimensional and more authentic appearing toy sword which is safe and convenient for a child to use is desirable.

This and other objects of this invention will become apparent from the following disclosure and appended claims.

SUMMARY OF THE INVENTION

This invention relates to a toy sword which provides a large, three-dimensional and authentic appearance. The sword of this invention is fabricated from a flat sheet of foam material from which first and second blade and handle subparts are cut. Each blade and handle sub-part includes an internal, longitudinally extending interlocking plug and slot formation whereby the first and second subparts can be interfitted so as to form a three-dimensional and substantial appearing sword having a cross-shaped cross-section. A planar guard having a central, internal and cross-shaped aperture is constructed to be fitted over the blade, slid toward the handle portion, and grasped by a guard grasping section between the blade portion and handle portion.

In another embodiment a lightning bolt configuration is provided. The bolt is fabricated from two subparts, each of which includes an interfitting and interlocking plug and aperture formation. This bolt can be used as a toy for throwing like a javelin or a sports novelty item to depict team emblems and the like.

Many other devices can be made employing the systems disclosed herein. Such devices can include: bats, battle axes, hammers, building, blocks, etc.

DESCRIPTION OF THE PREFERRED EMBODIMENT

In General

Figure 1:
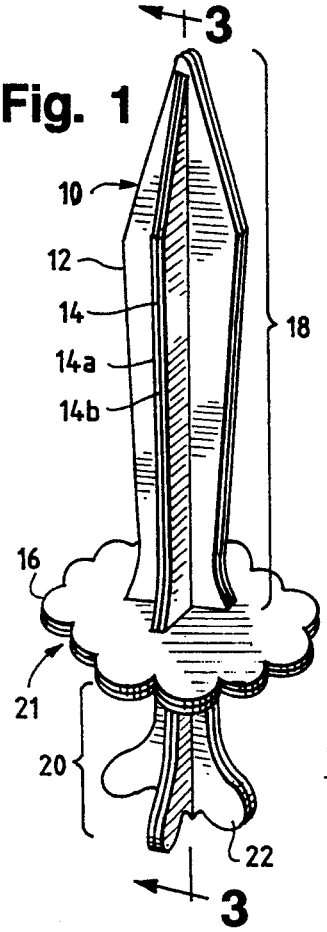
FIG. 1 is a perspective view of a sword in accordance with this invention.

Referring now to FIG. 1, there is shown a toy sword 10 fabricated of three components described hereinafter and made of a layered or unlayered flexible foam polyethylene or other similar material. The sword includes first and second elongated blade and handle subparts 12 and which are assembled together as described hereinafter. A guard 16 is fitted to the assembled subparts so as to complete the sword. The guard is positioned in a grasping section that is located between the blade and handle. The guard is fitted to the blade and handle subparts by sliding the guard from the blade end to the grasping section. The sword includes a blade portion 18, a handle portion 20, and a grasping section therebetween, generally indicated by reference numeral 21. It is noted that at the handle end there is an enlarged and decorative end formation or handle knob 22. As described hereinafter, the guard 16 cannot fit over the handle knob 22.

As seen in FIG. 1, the foam material is laminated to form a pair of layers that are bonded together. This can be best seen in FIG. 1 in connection with the blade which is fabricated of layers 14a and 14b.

More Specifically

Figure 3:
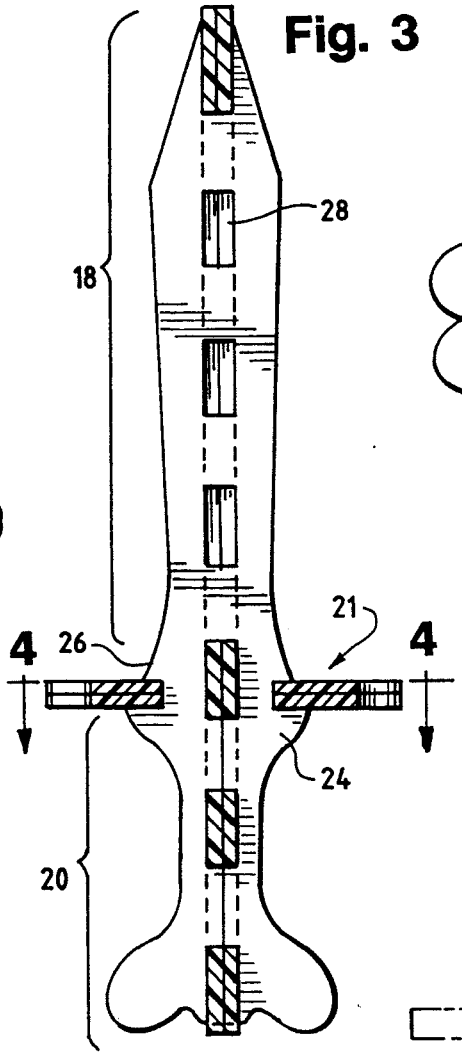
FIG. 3 is a vertical section of the sword in FIG. 1 taken along lines III—III.

Turning now to FIG. 3, one can see the blade portion 18, the handle portion 20, and the grasping section 21 generally. The grasping portion includes a cross-shaped body that is bounded by a lower flange 24 which is sometimes referred to as a handle base and an upper flange 26, which is sometimes referred to as a blade base. The space or body between the two flanges grasps the guard section 16. It is also noted that the blade base or flange 26 is not as wide (i.e., does not extend as far from the center of the subpart) as the handle base or flange 24. This is intended to prevent the guard from slipping onto the handle and to assure mounting of the guard from the blade section. Each of the blade and handle subparts include an internal and longitudinally extending interlocking formation that is generally referred to as 28 in FIG. 3. This formation includes a series of plugs and apertures which assure that the two blade and handle subparts 12 and 14 can be matingly fitted together so as to provide a substantial three-dimensional appearance for the toy and cross-shaped cross-section as shown in FIG. 4 at 30.

Figure 4:
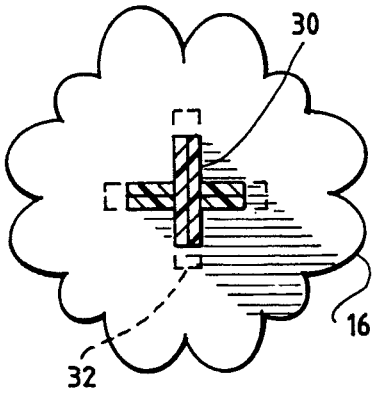
FIG. 4 is a horizontal sectional view showing the guard mounted on the sword and generally taken along lines IV—IV of FIG. 3.

Referring now to FIG. 4, the guard 16 includes a cross-shaped aperture 32 which fits over the cross-shaped section of the blade and can be slid into place. The external surface or end design for the guard 16 can be of any appropriate decorative shape.

Figure 5:
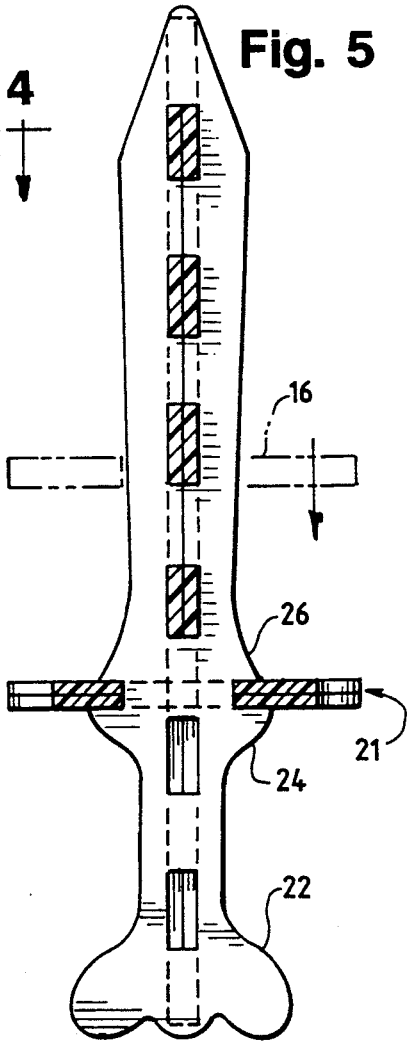
FIG. 5 is a vertical view of the sword as in FIG. 1 with the guard being mounted to the sword from the blade end.
Figure 2:
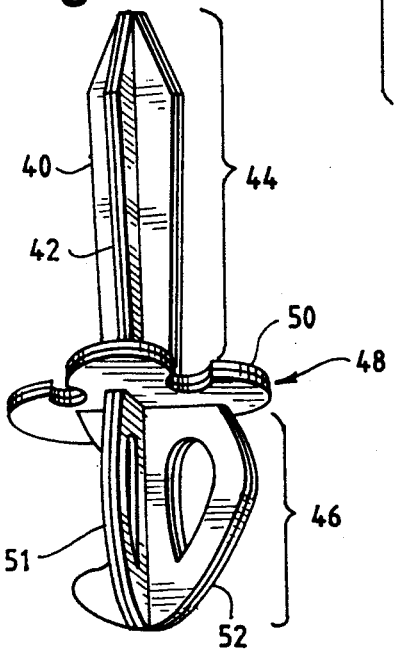
FIG. 2 is a view similar to that of FIG. 1 of a toy sword having a handle which includes a hand-shielding portion.

As suggested in FIG. 5, the guard 16 can be slid from the top end of the blade down the length of the blade, fitted past the small flange 26 and into position in the grasping section 21 where it is held in position on the body between the flange 26 and the flange 24. The guard cannot be mounted from the handle end as the decorative end formation 22 is substantially larger than the aperture 32.

Hand Shield Embodiment of FIGS. 2, 6, 7, 8 & 9

Referring now to FIGS. 2, 6, 7, 8 and 9, a second embodiment of the sword, very similar to that described hereinbefore is shown. In connection with each, there are two handle and blade subparts which are fitted together and a guard section which is held in position by a grasping section. More particularly, there are two subparts 40 and 2 which form the blade portion 44 and handle portion 46. A grasping section 48 is positioned intermediate the handle and the blade portions and a guard 50 is fitted into the grasping section. The handles are somewhat different than described in connection with the previous embodiment and include the hand encompassing or shield sections 51 and 52.

Figure 6:
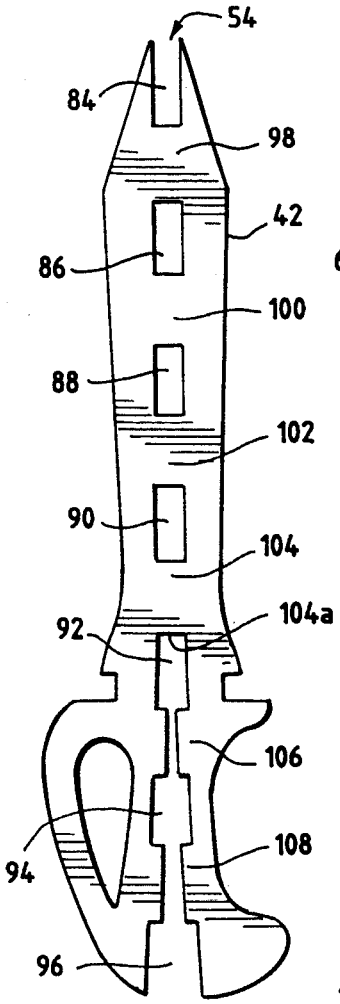
FIG. 6 is a plan view showing a blade and handle subpart of the sword of the type shown in FIG. 2.
Figure 7:
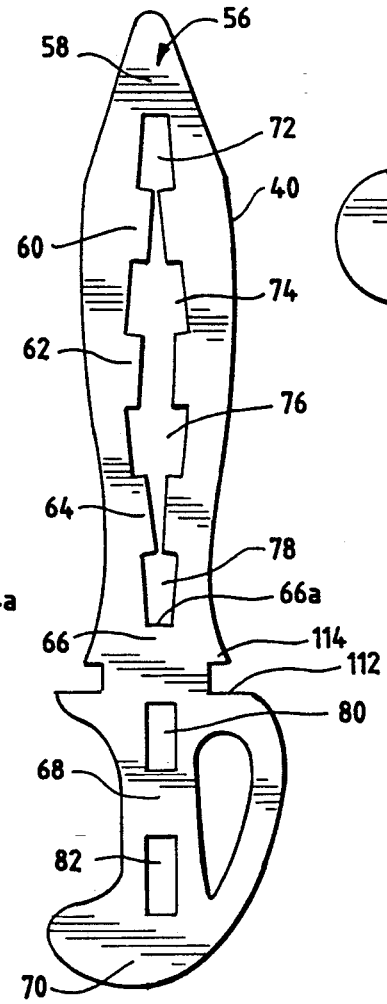
FIG. 7 is a view like FIG. 6 showing the other blade and handle subpart of the sword of FIG. 2.

Referring to FIGS. 6 and 7 particularly, the interlocking systems 54 and 56 generally, can be seen. Each formation can be thought of as an elongated Greek key design or as alternating plugs and apertures or slots. A plug from one part fits at right angles into the slot of the other part. Moreover, it is seen that the blade tip of one part is open or slotted and the handle of the same part is slotted and slit so as to open by spreading and a cross-over part of the grasping section is a slot. The other subpart is closed at the tip end, closed at the handle end, and closed at the grasping section. In that formation the plugs between the tip and grasping section are slit so that the part can be opened between the blade tip and grasping section.

In this other part 40, a solid plug is provided in the grasping section to engage the slot in the grasping section of the other part. Moreover, the handle section is slotted but is not slit so as to open. The two formations are arranged such that the slots and plugs alternate so as to assume the mating and interfitting relationship. In each of the blade and handle subparts, the number of slots and plugs is an odd number, and in each particular embodiment shown herein, the total number of slots and plugs in each formation is thirteen. Both parts can be thought of as having positions for plugs and slots.

While the total number of slots and plugs for the embodiment above is shown to be thirteen, an odd number, the total of the slots and plugs can be an even number and be successful.

In further detail, one subpart 40 has plugs 58, 60, 62, 64, 66, 68, and 70. Slots are provided at 72, 74, 76, 78, 80 and 82. Thus the plugs can be thought of as in the odd positions and the slots in the even positions. The situation is exactly the opposite in the other subpart 42. There, slots are provided at the positions 84, 86, 88, 90, 92, 94 and 96, while plugs can be provided at positions 98, 100, 102, 104, 106 and 108. It will be noted that subpart 42 in FIG. 6 is slit at the bottom so that the plugs 106 and 108 are slit in half. The other subpart 40 is slit in the blade portion and there plugs 60, 62 and 64 are slit.

The Assembly Operation

Figure 8:
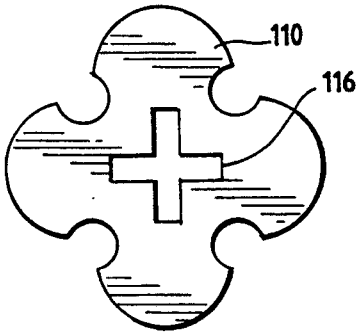
FIG. 8 is a plan view of a guard of the type that could fit on the assembled parts of FIGS. 6 and 7.
Figure 9:
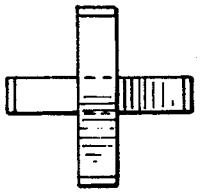
FIG. 9 is a view showing the manner in which the subpart of FIG. 6 engages the subpart of FIG. 7.

The foregoing systems with reference to FIGS. 2, 6, 7, 8 and 9, as explanatory, are assembled by spreading open the slit portion of the part 40 so that the blade is split open. Next, the legs of the handle section of part 42 are spread apart and the second part 42 is inserted into the first part 40 by inserting one of the spread legs into the slit of part 40 and then urging it down until a lower shoulder 104a of part 104 engages an upper shoulder 66a of plug 66. Thus at the crossover, the plug 66 engages the slot 92. Then the remainder of the blade of the second part 42 is fitted into the slot and into the part 40. Next, the slits are closed so that tip or plug 58 fits slot 84, plug 98 fits slot 72, split plug 60 fits slot 86, plug 100 fits slot 74, slit plug 62 fits slot 88, plug 102 fits slot 76, slit plug 64 fits slot 90, plug 104 fits slot 78, plug 66 fits slot 92, slit plug 106 fits slot 80, plug 68 fits slot 94, slit plug 108 fits slot 82, and plug 70 fits slot 96. This can also be seen in FIG. 3 where the plugs of one part are shown positioned within the slots of the other part. Once the two subparts, such as 40 and 42 are assembled together, then the guard such as 110 in FIG. 8 is slid from the blade end downwardly into the grasping section, engaging the body section and is bounded by the flanges 112 and 114.

The Guard Piece

The guard piece either 16 or 110 includes a central cross-shaped aperture such as 32 or 116 which are approximately the same size as the cross-shaped body section of the grasping section. Thus a guard is urged from the tip end of the blade downwardly, past the flange such as 26 or 114, and into engagement with the larger handle flange (or hand shield) such as 24 or 112. In that position the guard is then secured in position between the blade and the handle. The guard is viewed as protecting the hand from particular types of blows and also as a decorative piece. Finally, the hand can be protected using the hand shields such as 50 and 52 or may be exposed and rely only upon the guard.

The Lightning Bolt Embodiment

Figure 10:
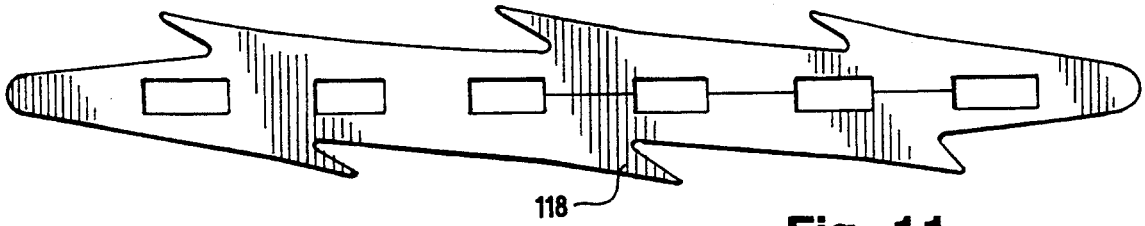
FIG. 10 depicts a subpart of a lightning bolt construction.
Figure 11:
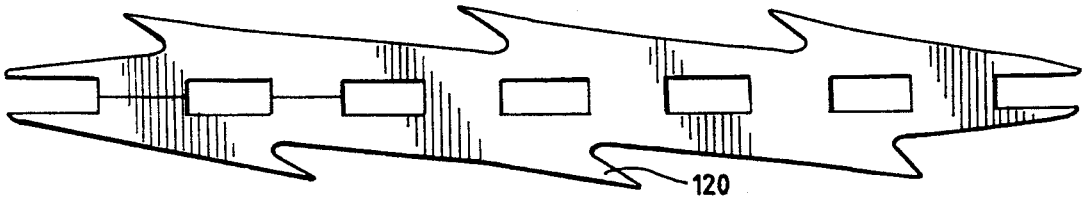
FIG. 11 discloses a mating subpart to that of FIG. 10 for the lightning bolt configuration.

Turning now to FIGS. 10 and 11, there is shown a lightning bolt that is illustrated and assembled in the same manner as the blade and handle subparts of FIGS. 6 and 7. The lightning bolt subparts are identified as numerals 118 and 120 and have the same type of matingly interlocking formation of slits, plugs and slots as the sword. However, it is noted that there is no guard piece or grasping section provided on the lightning bolt. The interlocking system and manner of assembly of the lightning bolt is the same as in connection with the sword.

The Full-Slit Embodiment

Figure 12:
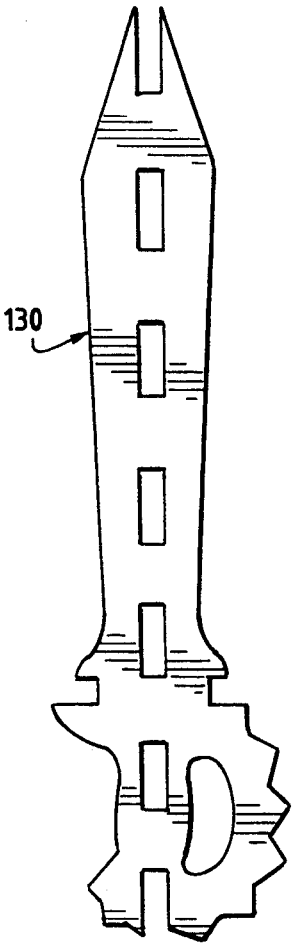
FIGS. 12, 13 and 14 show another embodiment where one subpart is slit from adjacent the top to adjacent the bottom to receive the other subpart which is not so slit and a hand guard is shown that can be fit thereover.
Figure 13:
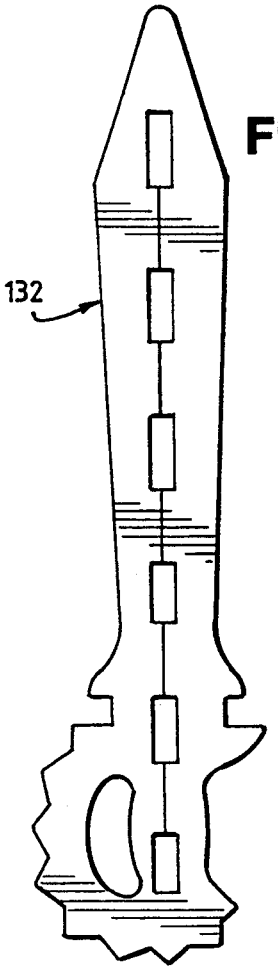
Figure 14:
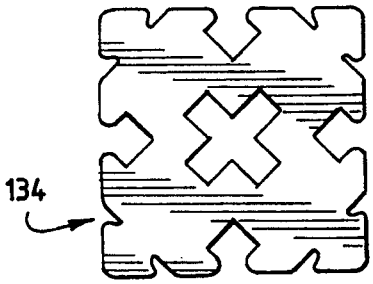

Referring to FIGS. 12, 13 and 14, a full-slit embodiment is disclosed. In that embodiment a three-piece sword is shown which includes a first or unslit blade subpart 130, a second or slit blade subpart 132, and a guard subpart 134 for mounting on the assembled blade subparts. In this embodiment it is seen that the first subpart 130 is open at the top and bottom end. On the other hand, the second blade subpart 132 is split between the top and bottom, in other words the plug portions between the top and bottom plugs are slit. In order to assemble the sword, the second subpart 130 is spread open and the first subpart 130 is inserted therein so that the open top of the first subpart engages the closed top of the second subpart. Then with the second subpart opened, the base or open bottom of the first subpart is inserted into the closed bottom of the second part. The first subpart is thus positioned within the second subpart. Then the split plugs of the second subpart are secured in the slots of the first subpart. Thus the cross-shaped cross-section is formed. Then the guard such as 134 is slipped down the blade and into the grasping section formed by the blade subparts 130 and 132.

A Four-Piece Embodiment

Figure 15:
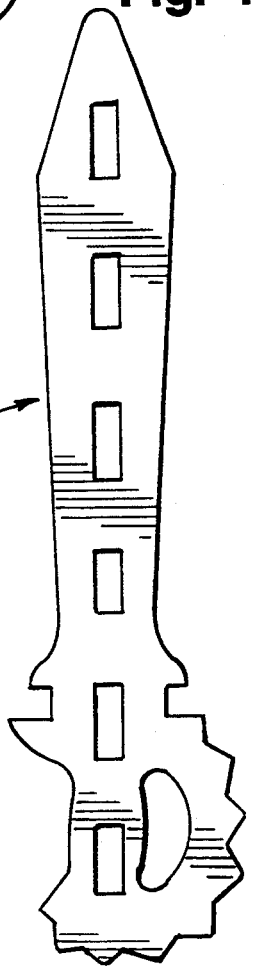
FIGS. 15, 16 and 17 show yet another embodiment where one subpart is solid and the other subpart is slit from top to bottom so as to interfit therewith, and a hand guard is provided to be secured to the subparts.
Figure 16:
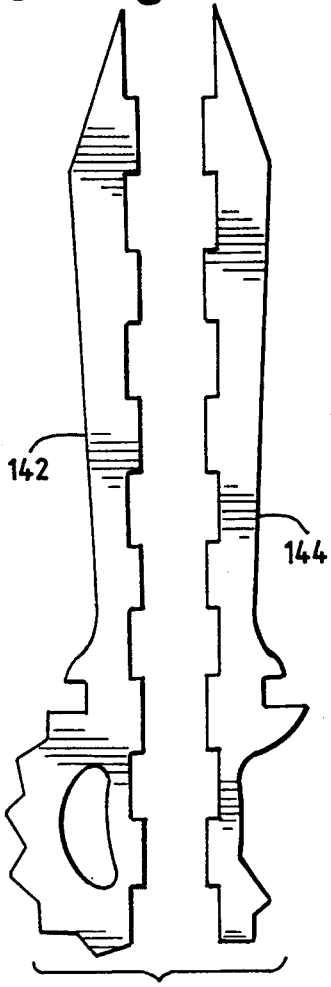
Figure 17:
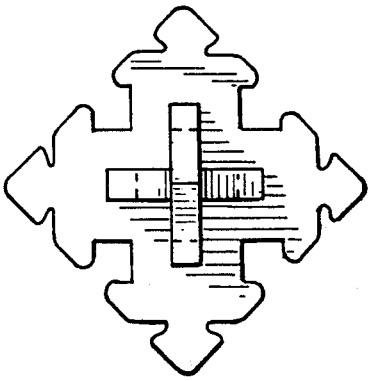

Referring now to FIGS. 15, 16 and 17, there is shown a four-piece sword embodiment. A one-piece first subpart 140 with a closed or plugged top and a closed or plugged bottom end is shown in FIG. 15. A second blade subpart, which is in two longitudinal pieces 142 and 144, is shown in FIG. 16. The assembled second subpart can be considered to have an open or slotted top end and an open or slotted bottom end. In order to assemble the sword, one-half of the second subpart, say 142, is fitted to one side of the first subpart 140 by inserting the plug parts of the part 142 fit into the slots in the first subpart 140. This longitudinal piece is secured in place, preferably with an adhesive. Then the second piece 144 is secured in place, like the first piece. In other words, the piece 142 is fitted to the other side of subpart 140 with the plug parts of part 142 fitting within the slots of subpart 140 and then glued in place. In this way a sword with a cross-shaped cross-section is formed. Then a guard 146 is fitted to the assembled subparts in the grasping section so as to complete assembly of the sword.

While the invention has been described with reference to specific embodiments thereof, it will be appreciated that numerous variations, modifications, and embodiments are possible, and accordingly, all such variations, modifications and embodiments are to be regarded as being within the spirit and scope of the invention.

I claim as my invention:

1. A toy sword assembly fabricated of a lightweight, flexible and foam material which includes an elongated blade and handle part and a guard part that fits onto the blade and handle part, wherein:

a. the blade and handle part includes:
   (1) two elongated, interfitting and interlocking subparts which are assembled together and form a cross-shaped cross-sectional body;
   (2) a blade portion and a handle portion; and
   (3) a guard grasping section positioned between the blade portion and handle portion and having a cross-shaped body portion; and b. the guard part:
   (1) is substantially planar and one piece;
   (2) defines an internal aperture with a cross-shape construction to conform with and engage that portion of the cross-shaped body located in the guard grasping section;
   (3) is constructed to fit on the grasping section of the blade and handle part and between the blade portion and the handle portion; and
   (4) is oriented at substantially right angles to the blade and handle part.

2. A sword as in claim 1, wherein the two elongated, interfitting and interlocking subparts which form the cross-shaped cross-sectional body for the blade and handle part, each include an elongated formation of a plurality of slots and plug members constructed to matingly interfit and interlock with each other.

3. A sword as in claim 1, wherein the blade portion includes a first flange adjacent the grasping section and the handle portion includes a second flange adjacent the grasping section, with the grasping section including a cross-shaped body section positioned between the first flange and the second flange.

4. A sword as in claim 3, wherein the first and second flange extend outwardly from the cross-shaped body section and the second flange extends outwardly from the body section a distance greater than the first flange.

5. A sword as in claim 1, wherein the internal aperture of the guard section is smaller than the handle portion.

6. A sword as in claim 4, wherein the internal aperture of the guard section is smaller than the second flange.

7. A toy sword assembly fabricated of a lightweight, flexible foam material which includes an elongated blade and handle part and a guard part that fits onto the blade and handle part, wherein:

a. the blade and handle part includes:
   (1) two elongated, interfitting and interlocking subparts which are assembled together and form a cross-shaped cross-sectional body;
   (2) a blade portion and a handle portion; and
   (3) a guard grasping section positioned between the blade and handle portion and having a cross-shaped body portion; and b. the guard part:
   (1) is substantially planar and one piece;
   (2) defines an internal aperture with a cross-shaped construction to conform with and engage that portion of the cross-shaped body located in the guard grasping section;
   (3) is constructed to fit on the grasping section of the blade and handle part and between the blade portion and handle portion; and
   (4) is oriented at substantially right angles to the blade and handle part;

wherein the two elongated, interfitting and interlocking subparts which form the cross-shaped cross-sectional body for the blade and handle part, each include an elongated formation of a plurality of slots and plug members constructed to matingly interfit and interlock with each other;

wherein each formation defines (a) a plurality of positions, one for each plug and slot member, (b) an odd number of positions; (c) a first position for each subpart at one end thereof, and (d) a last position for each subpart at the other end thereof, and (e) a crossover point for each subpart between the first and last positions for cooperation in connecting the two subparts;

wherein one subpart includes a plug member at each end of the first and last positions and the other subpart has a slot at each of the first and last positions and the plugs and slots are in alternate positions as between subparts;

wherein slot and plug members are arranged to matingly engage and receive each other so as to maintain the first and second subparts at right angles to each other;

wherein the blade portion of the other subpart is constructed to fit within the blade portion of the one subpart between one end and the crossover point, the guard grasping section of the one subpart is constructed to engage the grasping section of the other subpart, and the handle portion of the other subpart is constructed to fit over the handle portion of the one subpart between the crossover point and the other end;

wherein the blade portion includes a first flange adjacent the grasping section and the handle portion includes a second flange adjacent the grasping section with the grasping section including a cross-shaped body section positioned between the first flange and the second flange;

wherein the first and second flange extend outwardly from the cross-shaped body section and the second flange extends outwardly from the body section a distance greater than the first flange;

wherein the internal aperture of the guard section is smaller than the handle portion; and wherein the internal aperture of the guard section is smaller than the second flange.

8. An elongated assembly fabricated of a foam material which includes two elongated, interfitting and interlocking parts which form a cross-shaped cross-sectional configuration, wherein:

each part includes and defines a plurality of alternating plug and slot members that are constructed and arranged to matingly engage and receive plug and slot members of the opposite part;

each part including a first end and a second end and a crossover point therebetween for cooperation and connecting the two parts;

each part includes a plurality of plug and slot members with the first and second end of one part having plug members thereat, and the first and second end of the other part having slot members thereat;

the one part having slit plug members between the first end and the crossover point so as to be separable and form a slot therebetween;

the other part having plug members between the crossover point and the second end each of which are slit so as to form separable portions and define a slot therebetween;

whereby the two parts are assembled together and the respective slot and plug members are caused to matingly engage by inserting the other part into the one part between the first end and crossover point so that a plug and a slot member engage at the crossover point and the one part is positioned between the separable portions of the other part which are then caused to engage the one part between the crossover point and the second end.

9. An elongated assembly as in claim 8, wherein the total number of plug and slot positions on each part is an odd number.

10. An elongated assembly fabricated of a foam material which includes two elongated, interfitting and interlocking parts which form a cross-shaped cross-sectional configuration, wherein:

each part includes and defines a plurality of alternating plug and slot members that are constructed and arranged to matingly engage and receive plug and slot members of the opposite part;

each part including a first end and a second end, with both ends of one part being open or slot members, and both ends of the other part being closed or plug members;

the other part having those plug members between the first end and second end slit so as to form a slot between the first end and second end upon separation of the slit plug members;

whereby the two parts are assembled together and the plug member of the other part at the ends thereof engaging the end slot members of the one part; and plug members of the one part engaging the slot members of the other part between the ends so as to form an assembly having a cross-shaped cross-section.

11. A toy sword assembly fabricated of a lightweight, flexible and foam material which includes an elongated blade and handle part and a guard part that fits onto the blade and handle part, wherein:

a. the blade and handle part includes:

(1) a plurality of elongated, interfitting and interlocking subparts which are assembled together and form a cross-shaped cross-sectional body;

(2) a blade portion and a handle portion; and (3) a guard grasping section positioned between the blade portion and handle portion and having a cross-shaped body portion; and b. the guard part:

(1) is substantially planar and one piece;

(2) defines an internal aperture with a cross-shape construction to conform with and engage that portion of the cross-shaped body located in the guard grasping section;

(2) is constructed to fit on the grasping section of the blade and handle part and between the blade portion and the handle portion; and (3) is oriented at substantially right angles to the blade and handle part.

12. A toy sword assembly fabricated of a lightweight, flexible and foam material which includes an elongated handle and blade part and a guard part that fits onto the blade and handle part, wherein:

a. the blade and handle part includes:

(1) two elongated, interfitting and interlocking subparts which are assembled together and form a cross-shaped cross-sectional body;

(2) a blade portion and a handle portion; and (3) a guard grasping section positioned between the blade portion and handle portion and having a cross-shaped body portion; and b. the guard part:

(1) is substantially planar and one piece;

(2) defines an internal aperture with a cross-shape construction to conform with and engage that portion of the cross-shaped body located in the guard grasping section;

(3) is constructed to fit on the grasping section of the blade and handle part and between the blade portion and handle portion; and (4) is oriented at substantially right angles to the blade and handle part;

wherein the two elongated, interfitting and interlocking subparts which form the cross-shaped cross-sectional body for the blade and the handle part, each include an elongated formation of a plurality of slots and plug members constructed to matingly interfit and interlock with each other;

wherein each formation defines (a) a plurality of positions, one for each plug and slot member; (b) an odd number of positions; (c) a first position for each subpart at one end thereof; (d) a last position for each subpart at the other end thereof; and (e) a crossover point for each subpart between the first position and last position, said crossover point for cooperation in connecting the two subparts; and wherein one subpart includes a plug at each of the first and last positions and the other subpart has a slot at each of the first and last positions and the plugs and slots are in alternative positions as between subparts.

13. A sword as in claim 12, wherein slot and plug members are arranged to matingly engage and receive each other so as to maintain the first and second subparts at right angles to each other.

14. A sword as in claim 13, wherein the blade portion of the other subpart is constructed to fit within the blade portion of the one subpart between the crossover point and one of the first or the last positions; the guard grasping section of the one subpart is constructed to engage the guard grasping section of the other subpart; and the handle portion of the other subpart is constructed to fit over the handle portion of the one subpart between the crossover point and the other of the first and last positions.

* * * * *